US008287331B2

(12) United States Patent
Kanaya et al.

(10) Patent No.: US 8,287,331 B2
(45) Date of Patent: Oct. 16, 2012

(54) METHOD FOR MANUFACTURING POLISHING PAD, AND METHOD FOR POLISHING WAFER

(75) Inventors: Koichi Kanaya, Tokyo (JP); Masayoshi Sekizawa, Niigata (JP); Naotaka Toyama, Gunma (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 1213 days.

(21) Appl. No.: 12/078,525

(22) Filed: Apr. 1, 2008

(65) Prior Publication Data

US 2008/0248728 A1 Oct. 9, 2008

(30) Foreign Application Priority Data

Apr. 5, 2007 (JP) ..... 2007-099184

(51) Int. Cl.
*B24B 37/04* (2012.01)
*B24B 1/00* (2006.01)

(52) U.S. Cl. ..... 451/36; 51/298; 428/218; 451/41

(58) Field of Classification Search ..... 51/293, 51/297, 298; 451/36, 41, 526, 527, 533, 451/539; 428/218
See application file for complete search history.

(56) References Cited

U.S. PATENT DOCUMENTS 7,086,932 B2 * 8/2006 Vangsness et al. ..... 451/28
2002/0155801 A1 * 10/2002 Roberts et al. ..... 451/528
2005/0171225 A1 * 8/2005 Kulp ..... 521/155
2007/0042693 A1 * 2/2007 Saikin ..... 451/527
2008/0146131 A1 * 6/2008 Vangsness et al. ..... 451/534

FOREIGN PATENT DOCUMENTS

| | | |
|---|---|---|
| EP | 1 097 026 B1 | 11/2002 |
| JP | A-10-202511 | 8/1998 |
| JP | A-10-249717 | 9/1998 |
| JP | A-11-267978 | 10/1999 |
| JP | A-2002-520174 | 7/2002 |
| JP | A-2007-038372 | 2/2007 |
| WO | WO 2005/110675 A2 | 11/2005 |

OTHER PUBLICATIONS

Japanese Office Action issued Jan. 17, 2012 for Japanese Patent Application No. 2007-099184 (with partial translation).

* cited by examiner

*Primary Examiner* — Timothy V Eley
(74) *Attorney, Agent, or Firm* — Oliff & Berridge, PLC

(57) ABSTRACT

There is disclosed a method for manufacturing a polishing pad that is formed of a urethane foam pad and attached to a turn table to polish a wafer, the method comprising at least steps of: slicing a urethane foam cake to provide the urethane foam pad; and performing press processing with respect to the urethane foam pad with a pressure of 15000 g/cm$^2$ or above, a polishing pad manufactured by this method, and a method for polishing a wafer by using this polishing pad. There can be provided a method for manufacturing a polishing pad that can stably obtain a wafer with high flatness, etc.

16 Claims, 7 Drawing Sheets

METHOD FOR MANUFACTURING POLISHING PAD, AND METHOD FOR POLISHING WAFER

BACKGROUND OF THE INVENTION

1. Field of the Invention

The present invention relates to a method for manufacturing a polishing pad utilized to polish a wafer, a polishing pad, and a method for polishing a wafer.

2. Description of the Related Art

With advancement of high integration of a semiconductor device, a very high level has been demanded with respect to flatness of a semiconductor wafer as a material of the semiconductor device.

When polishing a wafer, e.g., such as a semiconductor wafer, a technique of attaching a polishing pad to an upper side of a turn table and the wafer is slidably contacted to this polishing pad with a polishing slurry interposed therebetween is used.

The polishing pad is roughly classified into a nonwoven type in which a nonwoven fabric is impregnated with polyurethane and a polyurethane type in which polyurethane is foamed. The polyurethane type generally has higher hardness than the nonwoven type. Further, the hardness of the polyurethane type polishing pad is adjusted by changing a composition of polyurethane as a material.

Higher hardness of the polishing pad is desirable to obtain a wafer with high flatness. However, the polishing pad with high hardness has a higher probability of occurrence of a scratch on a wafer. Therefore, appropriately high hardness of the polishing pad must be selected.

On the other hand, a urethane cake as a raw material of a polyurethane type polishing pad has a fluctuation in a density in the cake, and this becomes a local density fluctuation of the polishing pad. The density fluctuation affects flatness of a polished wafer as unevenness of hardness.

When using the polyurethane type polishing pad, a wafer can be flattened and polished with a relatively high accuracy, but this accuracy is still insufficient in terms of a very high flatness level that has been recently demanded, and a yield ratio is also poor.

Although the polishing pad is fixed to a turn table and then a surface treatment (e.g., brushing, seasoning, or dressing) is effected to solve such a problem, flatness of a wafer cannot be sufficiently stably obtained. Further, there is also a problem of loss of a time required to perform such a surface treatment, loss of productivity due to this time loss, or a reduction in a lifetime of the polishing pad.

Furthermore, although a measure for improving the polishing pad itself has been proposed to obtain flatness of a wafer (Japanese Patent Application Laid-open No. 267978-1999 and others), flatness of a wafer cannot be sufficiently stably obtained.

SUMMARY OF THE INVENTION

In view of such a problem, it is a main object of the present invention to provide a method for manufacturing a polishing pad that can stably obtain a wafer with high flatness.

To achieve this object, according to the present invention, there is provided a method for manufacturing a polishing pad that is formed of a urethane foam pad and attached to a turn table to polish a wafer, the method comprising at least steps of: slicing a urethane foam cake to provide the urethane foam pad; and performing press processing with respect to the urethane foam pad with a pressure of 15000 g/cm$^2$ or above.

According to the method for manufacturing a polishing pad having the step of pressing the urethane foam pad with the pressure of 15000 g/cm$^2$ or above, a density distribution of the polishing pad can be more uniformed as compared with a conventional example, thereby manufacturing the polishing pad that can stably obtain a wafer with high flatness.

In this case, it is preferable to have a step of buffing at least a surface of the urethane foam pad that is to be attached to the turn table after the step of performing the press processing.

When at least the surface (back surface) of the urethane foam pad that is to be attached to the turn table is buffed after the press processing step in this manner, flatness of the back surface (surface attached to the turn table) of the polishing pad can be improved. As a result, a front surface (polishing surface) of the polishing pad when attached to the turn table can be more assuredly flattened.

Moreover, it is preferable to have a step of removing a peripheral portion of the urethane foam pad after the step of performing press processing.

When the peripheral portion of the urethane foam pad is removed after the press-processing step in this manner, the density distribution of the polishing pad can be more assuredly uniformed.

Additionally, it is preferable to have a step of bonding the surface of the urethane foam pad that is to be attached to the turn table to a double-sided adhesive tape and a step of buffing a surface of the urethane foam pad opposite to the surface of the same bonded to the double-sided adhesive tape after the step of performing the press processing.

When the surface (back surface) of the urethane foam pad that is to be attached to the turn table is bonded to the double-sided adhesive tape and the surface (front surface) opposite to the surface (back surface) of the urethane foam pad that is to be attached to the turn table is buffed after the press processing step in this manner, the front surface (polishing surface) of the polishing pad can be more assuredly flattened.

Further, according to the present invention, there is provided a polishing pad manufactured by the aforementioned method for manufacturing a polishing pad.

According to the polishing pad manufactured by the aforementioned method for manufacturing a polishing pad, since a density distribution is uniform as compared with a conventional example, the polishing pad that can stably obtain a wafer with high flatness can be provided.

Furthermore, according to the present invention, there is provided a method for polishing a wafer, wherein a polishing pad manufactured by the aforementioned method for manufacturing a polishing pad is attached to the turn table, and the turn table having the polishing pad attached thereto is used to polish the wafer with a polishing slurry interposed between a front surface of the polishing pad and the wafer.

According to the method for polishing a wafer that attaches the polishing pad manufactured by the aforementioned method for manufacturing a polishing pad to the turn table and uses the turn table having the polishing pad attached thereto to polish a wafer with the polishing slurry interposed between the front surface of the polishing pad and the wafer, since the polishing pad with high density distribution uniformity of polyurethane can be used to polish the wafer with a polishing pressure with high uniformity, thereby providing the wafer having high flatness.

According to the method for manufacturing a polishing pad of the present invention, since the density distribution of the polishing pad can be uniformed as compared with a conventional example, the polishing pad that can stably obtain a wafer with high flatness can be manufactured.

Moreover, according to the method for manufacturing a wafer of the present invention, a wafer can be polished to stably realize high flatness, and an operation efficiency at the polishing step can be improved.

DETAILED DESCRIPTION OF THE REFERRED EMBODIMENTS

The present invention will now be explained in more detail hereinafter, but the present invention is not restricted thereto.

As explained above, a conventional technology has a problem that flatness of a polished wafer is insufficient and unstable.

The present inventors have examined a fluctuation in the flatness of a wafer and thereby found the following facts. That is, according to a conventional polishing pad made of polyurethane, flatness of a processed wafer is poor at an initial stage of a polishing pad life (used time of the polishing pad), an edge roll off amount (ROA) becomes considerably high in particular, and an SFQR (Site Front Least Squares Range) is also poor. It is to be noted that the ROA means a magnitude of sag at the outermost peripheral portion of a wafer, and it represents a difference in front surface height between a position that is 3 mm from a wafer outer periphery and a position that is 1 mm from the same when an inclination of a wafer front surface is corrected in a state where a wafer back surface is reformed into a flat surface. Furthermore, the SFQR means flatness represented as a sum of absolute values of respective maximum displacement amounts on a positive side and a negative side from a reference plane that is an in-site plane obtained by calculating data within a set site by a least square method. A width of the ROA and a width of the SFQR are not fixed, and they greatly fluctuate among polishing pads. Although a pad surface treatment, e.g., diamond dressing was performed to correct such fluctuations, a correction effect varies depending on each polishing pad, and the fluctuations cannot be sufficiently corrected in some cases. When continuing processing of each product in this state, the ROA and the SFQR are gradually improved depending on a used time of the polishing pad, and they are often stabilized in approximately 4000 minutes even though they fluctuate. However, levels of the stabilized ROA and SFQR are not fixed among the polishing pads, and they greatly fluctuate.

The present inventors have examined a factor of such a phenomenon and considered that a density of a polishing pad made of polyurethane locally fluctuates and such local unevenness in hardness of the polishing pad affects flatness of a polished wafer.

Moreover, the present inventors have keenly examined about a reason that unevenness of hardness arises in the polishing pad made of polyurethane in this manner.

Figure 2:
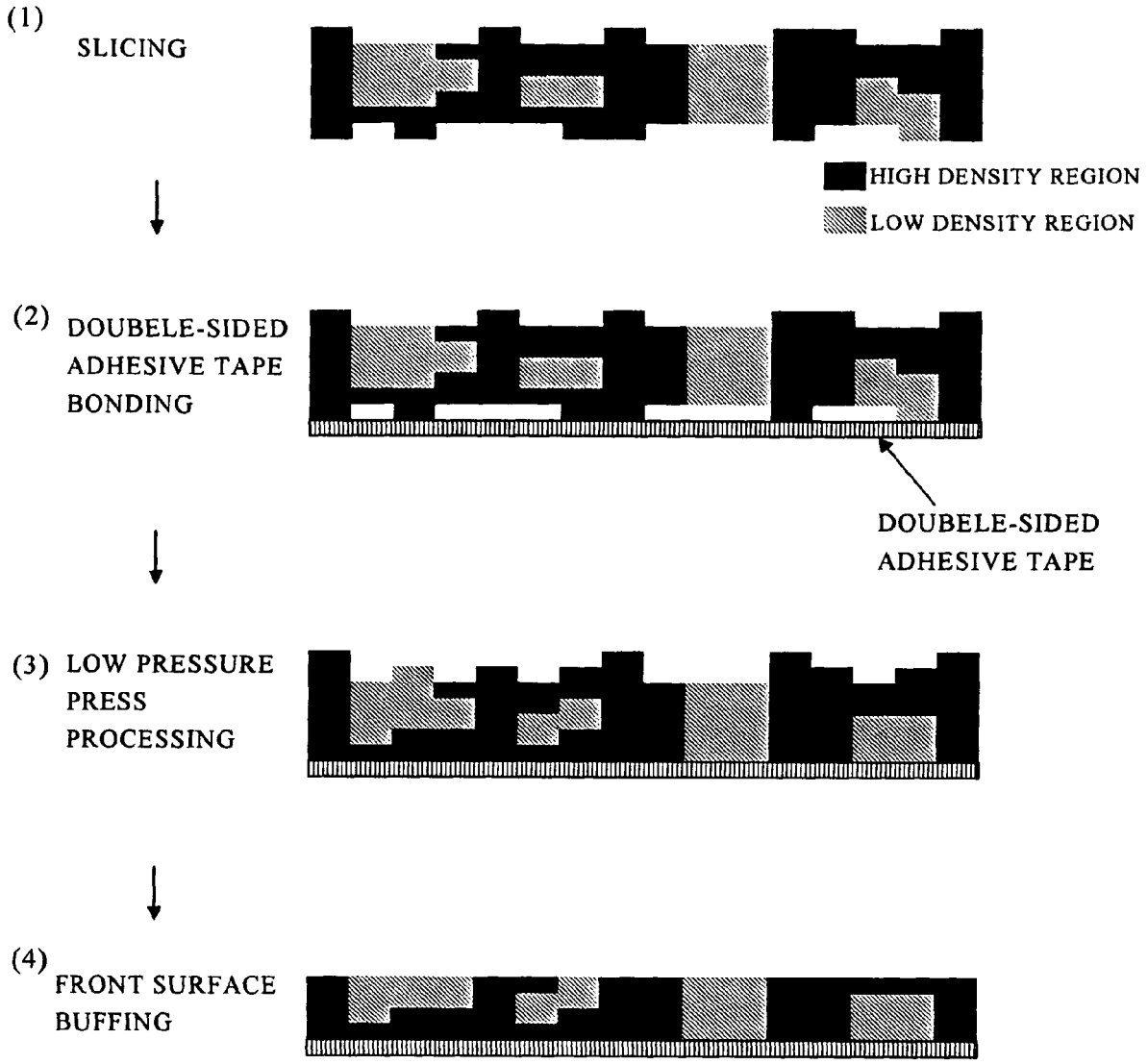
FIG. 2 is a conceptual view schematically showing an example of a conventional method for manufacturing a polishing pad.

FIG. 2 is a schematic conceptual view showing an example of a conventional method for manufacturing a polishing pad made of polyurethane.

A urethane foam cake as a block of polyurethane foam is sliced (cut) to obtain a urethane foam pad (step 1), thereby providing a polishing pad.

As shown in FIG. 2(1), the polishing pad immediately after slicing the urethane foam cake has both a region where a polyurethane density is high (which will be simply referred to as a "high density region" hereinafter in some cases) and a region where the density is low (which will be simply referred to as a "low density region" hereinafter in some cases). Additionally, small foams are produced in an actual polyurethane foam.

Then, this polishing pad is bonded to a double-sided adhesive tape (step 2).

Subsequently, press processing is carried out with a low pressure of, e.g., approximately 4000 g/cm$^2$ as required to remove relative large voids between the polishing pad and the double-sided adhesive tape (step 3).

Then, a side (polishing pad front surface; serving as a polishing surface at the time of polishing) of the polishing pad opposite to the side of the same bonded to the double-sided adhesive tape is buffed to remove roughness or waviness (step 4). Although roughness or waviness of the polishing surface of the polishing pad is removed to flatten this surface through such a series of processes as shown in FIG. 2(4), a distribution of the high density region and the low density region that is present from the beginning remains in the polishing pad.

When both the region where the density is high and the region where the density is low are present in the polishing pad in this manner, a distribution of a polishing pressure becomes non-uniform at the time of polishing, and this affects flatness of a wafer to be polished.

Further, in the above-explained conventional polishing pad, it can be considered that wafer flatness is particularly poor and unstable at the initial stage of a polishing pad life but the wafer flatness is gradually improved and stabilized with elapse of a used time of the polishing pad because the polishing pad is compressed during polishing the wafer and its density distribution is gradually uniformed.

Furthermore, based on such characteristics, the present inventors have conceived that previously performing press processing with a high pressure in such a manner that a density distribution of polyurethane in the polishing pad becomes a substantially uniform high-density region enables manufacturing the polishing pad that can stably provide a wafer with high flatness, thereby bringing the present invention to completion.

Embodiments according to the present invention will now be specifically explained hereinafter with reference to the accompanying drawings, but the present invention is not restricted thereto.

Figure 1:
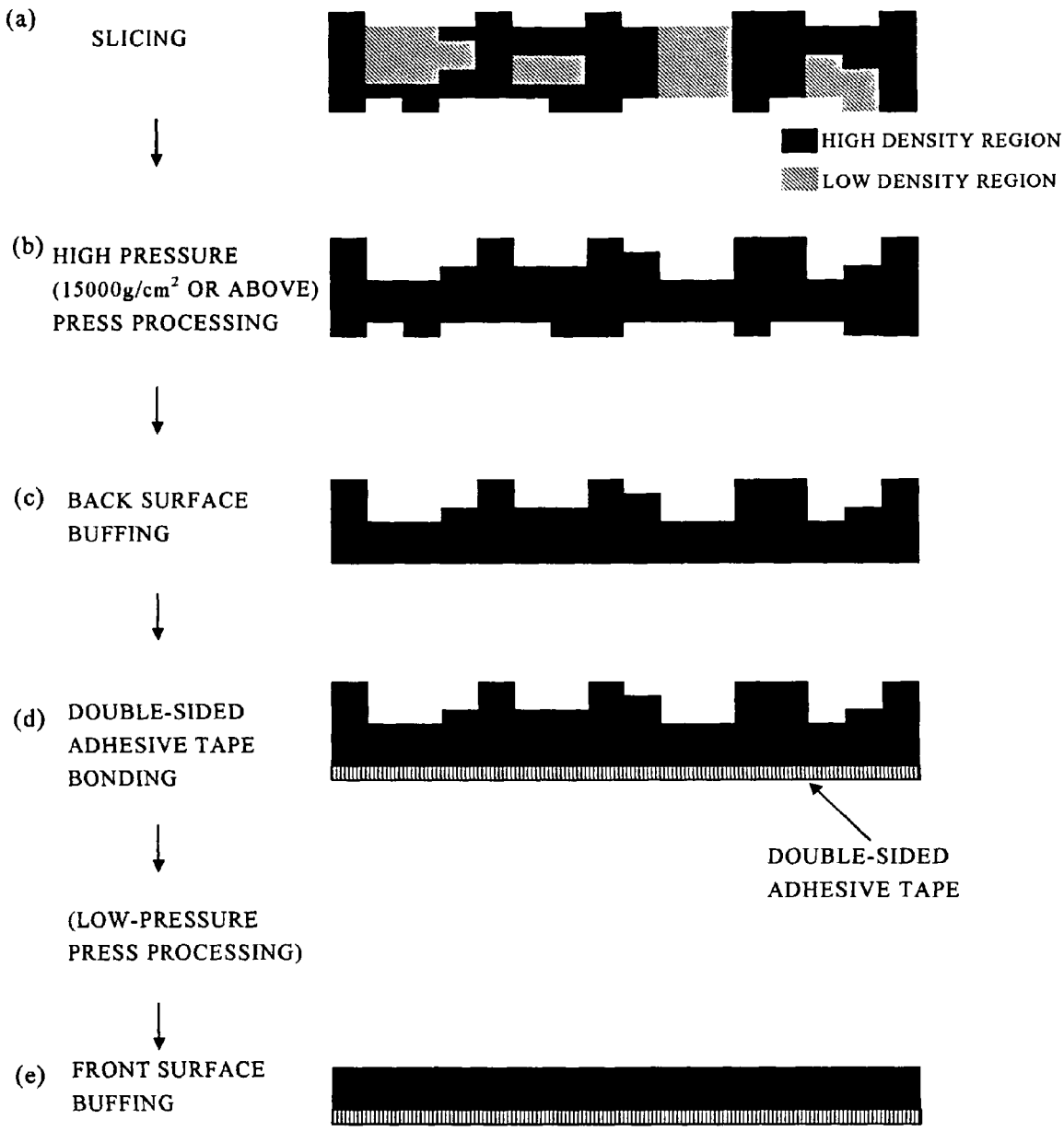
FIG. 1 is a conceptual view schematically showing an example of a method for manufacturing a polishing pad according to the present invention.

FIG. 1 is a conceptual view schematically showing a method for manufacturing a polishing pad made of polyurethane according to the present invention.

First, a urethane foam cake as a block of polyurethane foam is sliced to take out a urethane foam pad (step a).

The urethane foam cake may include a small amount of additives as long as a main component thereof is polyurethane, and the present invention can be applied if it is a urethane foam cake that is usually utilized for a polishing pad.

The urethane foam pad immediately after slicing the urethane foam cake has both a region where a polyurethane density is high and a region where the polyurethane density is low like the conventional example.

Then, press processing is carried out with a high pressure of 15000 g/cm$^2$ or above (step b). This high-pressure press processing uniforms the density distribution of the urethane foam pad. It can be considered that the high-pressure press processing enables reforming the region where the polyurethane density is low in the urethane foam pad to be turned to the region where the density is high. This press processing can be carried out by using a simple presswork machine. For example, this processing can be carried out by, e.g., placing the urethane foam pad on a lower press turn table and pressing an upper press turn table from above by its own weight, a dead-weight, and others, but the present invention is not restricted thereto. It is to be noted that a reason for setting the press pressure to 15000 g/cm$^2$ or above will be explained later.

Although the polishing pad according to the present invention can be manufactured in the above-explained manner, appropriately adding the following steps is desirable.

First, after the high-pressure press processing at the step b, at least a surface (back surface of the pad) of the urethane foam pad that is to be attached to the turn table is buffed (step c).

A double-side adhesive tape is usually bonded to the polishing pad in advance to fix the polishing pad to the turn table of the polishing apparatus, but the back surface of the polishing pad, i.e., the surface to which the double-side adhesive tape is bonded has roughness or waviness, and this also affects flatness of the wafer. Therefore, performing the above-explained back surface buffing processing to improve flatness of the back surface of the polishing pad is desirable.

It is to be noted that using a buffing processing method, which is usually carried out with respect to the polishing pad, as this buffing processing can suffice, and this method is not restricted in particular. For example, this buffing processing is performed by, e.g., scanning a front surface of the pad to grind the surface while rotating a roller having a small blade. Further, a buffing amount in this back surface buffing processing is not restricted in particular, and it can be, e.g., not smaller than approximately 0.01 mm and not greater than approximately 0.1 mm.

Then, this surface of the urethane foam pad that is to be attached to the turn table is bonded to the double-sided adhesive tape (step d).

A release paper sheet is usually bonded to a side of the double-sided adhesive tape opposite to a side of the same bonded to the urethane foam pad, and this release paper sheet is removed to attach the polishing pad to the turn table.

After bonding the urethane foam pad to the double-sided adhesive tape, press processing may be performed with a low pressure of, e.g., approximately 4000 g/cm$^2$ as required. Affecting this processing enables assuredly removing voids between the urethane foam pad and the double-sided adhesive tape.

Subsequently, the side (pad front surface; serving as a polishing surface at the time of polishing) of the urethane foam pad opposite to the side of the same bonded to the double-sided adhesive tape is buffed to remove roughness or waviness (step e). Carrying out this processing enables further increasing flatness of the polishing surface, and flatness of the wafer can be also improved to perform polishing. Furthermore, a buffing amount in this surface buffing processing is not likewise restricted in particular, and it may be, e.g., not smaller than approximately 0.01 mm and not greater than approximately 0.1 mm.

It is to be noted that the polishing pad is usually punched out in accordance with a shape of a bottom surface of the turn table to which the polishing pad is attached. However, when a polishing pad larger than the bottom surface of the turn table is used in advance to remove a peripheral portion of the urethane foam pad after the high-pressure press processing at the step b in the present invention, the polishing pad that uses a portion having a higher degree of uniformity in a density distribution in a pressed state (pad central portion before removal) at the time of polishing can be provided. Therefore, the density distribution of the polishing pad can be further assuredly uniformed, which is preferable.

A method for polishing a wafer by using the thus manufactured polishing pad will now be explained hereinafter.

In wafer polishing using the polishing pad according to the present invention, both a single-side polishing apparatus and a double-side polishing apparatus can be used, and known apparatuses can be adopted as these apparatuses.

For example, as the double-side polishing apparatus, it is possible to adopt an apparatus which is of a type that a sun gear and an internal gear are provided and a wafer revolves and rotates on its axis between a lower turn table and an upper turn table (see Japanese Patent Application Laid-open No. 249717-1998) or a type that a wafer does not revolve and rotate (see Japanese Patent Application Laid-open No. 202511-1998).

Moreover, these apparatuses can be used for polishing a semiconductor wafer, e.g., a silicon single crystal wafer as well as various kinds of wafers such as a glass substrate.

Figure 3:
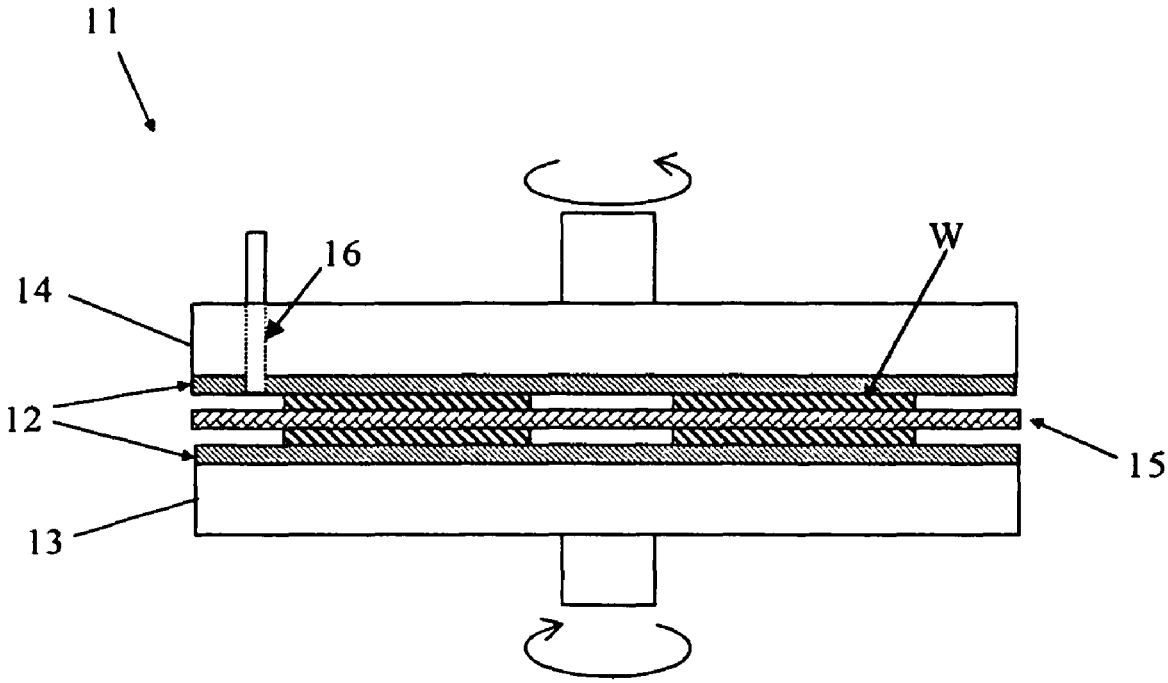
FIG. 3 is a schematic cross-sectional view showing an example of a double-side polishing apparatus including a polishing pad according to the present invention.

FIG. 3 is a schematic cross-sectional view showing an example of a double-side polishing apparatus including the polishing pad according to the present invention.

A double-side polishing apparatus 11 includes a lower turn table 13 and an upper turn table 14 that are provided to vertically face each other, and a polishing pad 12 according to the present invention is attached to each of opposed surfaces of the respective turn tables 13 and 14 through, e.g., a double-sided adhesive tape. A wafer W is held in a holding hole of a carrier 15 and sandwiched between the upper turn table 14 and the lower turn table 13. The upper turn table 14 and the lower turn table 13 are rotated by a non-illustrated driving source. At this time, the wafer W is held in the holding hole of the carrier 15 and both surfaces of the wafer W are simultaneously polished by the upper and lower polishing pads 12. At the time of polishing, a polishing slurry is supplied from polishing slurry supplying means 16.

Figure 4:
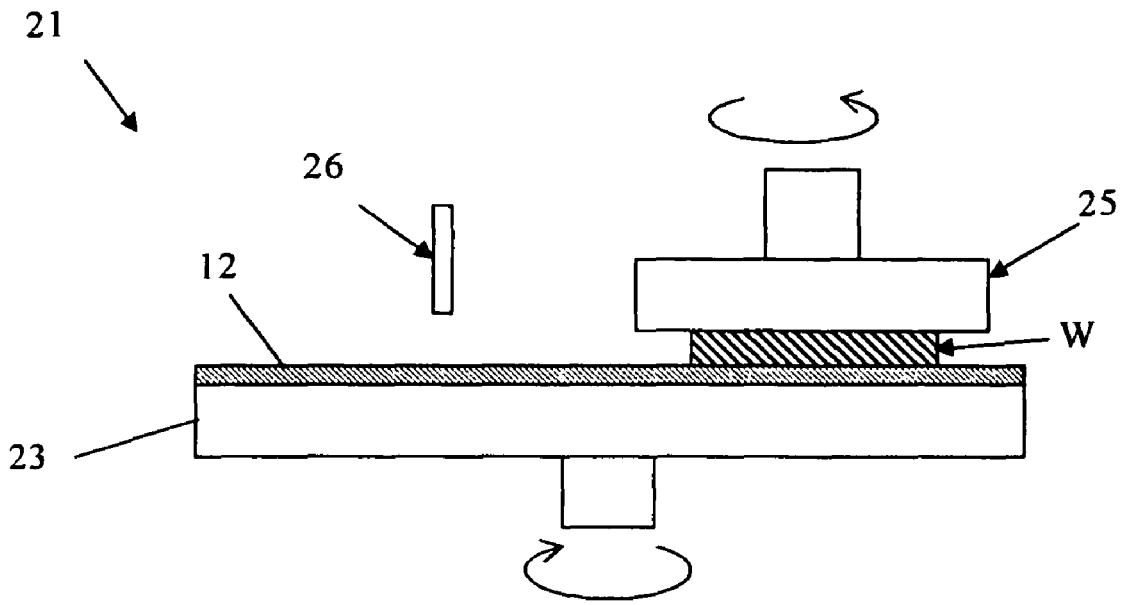
FIG. 4 is a schematic cross-sectional view showing an example of a single-side polishing apparatus including the polishing pad according to the present invention.

FIG. 4 is a schematic cross-sectional view showing an example of a single-side polishing apparatus including the polishing pad according to the present invention.

A single-side polishing apparatus 21 includes a turn table 23 to which a polishing pad 12 according to the present invention is attached through, e.g., a double-sided adhesive tape, a polishing head 25 that holds a wafer W, and polishing slurry supplying means 26. The turn table 23 and the polishing head 25 are rotated by a non-illustrated driving source, and the wafer W is slidably contacted to the polishing pad 12, thereby polishing a polishing target surface of the wafer W. At the time of polishing, a polishing slurry is supplied from the polishing slurry supplying means 26.

When such a wafer polishing method using the polishing pad manufactured by the polishing pad manufacturing method according to the present invention is adopted, the polishing pad having high uniformity of a density distribution can be used to polish a wafer with a polishing pressure having high uniformity, thereby providing the wafer having high flatness.

A reason that the high press pressure at the step b in FIG. 1 is set to 15000 g/cm$^2$ or above and others will now be explained with experimental examples.

EXPERIMENTAL EXAMPLES 1 to 6

Polishing pads were manufactured as follows based on the polishing pad manufacturing method according to the present invention shown in FIG. 1.

First, six urethane foam pads each having a thickness of approximately 0.8 mm were cut out from a urethane foam cake having a density of 0.5 g/cm$^3$ and an elastic modulus (compressibility factor) of 10000 to 13000 psi (69000 to 89000 kPa) (step a).

Then, press processing was carried out with respective pressures of 4000 g/cm$^2$ (two pads) (Experimental Examples 1 and 2), 15000 g/cm$^2$ (Experimental Example 3), 19000 g/cm$^2$ (Experimental Example 4), and 23000 g/cm$^2$ (two pads) (Experimental Examples 5 and 6) (step b).

Subsequently, back surface buffing processing was affected with respect to the urethane foam pads of the Experimental Examples 2 and 6 with a buffing amount of approximately 0.03 mm (step c).

Then, each urethane foam pad was bonded to a double-sided adhesive table having a thickness of 0.1 mm (step d).

Subsequently, front surface buffing processing was performed with respect to each urethane foam pad with a buffing amount of approximately 0.03 mm (step e).

Each of the thus manufactured 6 polishing pads was attached to a turn table, a wafer was actually polished without performing a special surface treatment, e.g., dressing, and its polishing quality was evaluated.

As a type of the polished wafer, a P-type (specific resistance: 1 Ωcm or above) silicon single crystal wafer having a diameter of 300 mm was used.

As a polishing apparatus, a double-side polishing machine manufactured by Fujikoshi Machinery Corp. was used. In this machine, a carrier made of a glass epoxy is placed on a lower turn table, five wafers are set in a holding hole portion of this carrier, an upper turn table is placed thereon, and polishing is carried out while flowing a polishing slurry. The lower turn table and the upper turn table rotate in opposite directions, and the carrier also oscillates and rotates.

A polishing time was set to approximately 30 to 60 minutes per batch, and a polishing pressure was set to approximately 16 to 20 kPa. Polishing was performed while replacing the wafers until a used time of each polishing pad reached approximately 9000 to 10000 minutes.

An ROA of each wafer polished in this manner was evaluated as follows.

As a measurement apparatus, a flatness measurement apparatus Nanometro manufactured by KURODA Precision Industries Ltd. was used. In this measurement apparatus, a wafer is arranged between two laser sensors, scanning using the laser sensors is performed to measure a thickness of the wafer, and this data is subjected to calculation to obtain an ROA. An inclination of a wafer front surface was corrected with a wafer back surface being reformed into a flat surface, and a difference in front surface height between a position that is 3 mm from a wafer outer periphery and a position that is 1 mm from the same was calculated.

Figure 5:
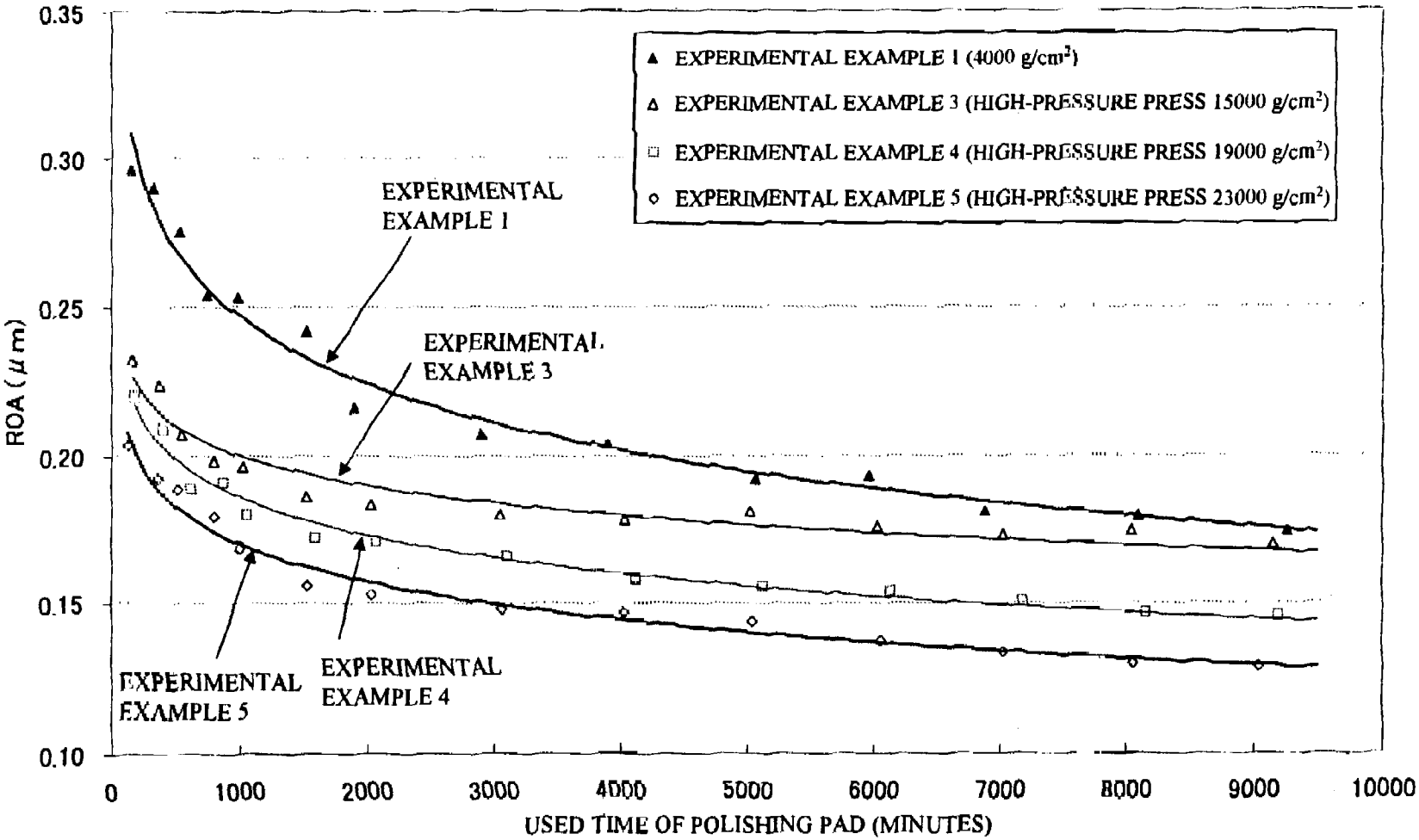
FIG. 5 is a graph showing a relationship between a used time and an ROA of the polishing pad.

FIG. 5 is a graph showing a relationship between a used time and an ROA of the polishing pad in each of Experimental Examples 1, 3, 4, and 5, i.e., examples with no back surface buffing processing. When a press pressure in Experimental Example 1 was 4000 g/cm$^2$, an ROA of a wafer at the beginning of using the polishing pad was as high as 0.30 μm, and a used time of 4000 minutes of the polishing pad was required to reduce the ROA to 0.20 μm or below, and sufficient wafer flatness was not able to be obtained in this period. An attenuation of the ROA was reduced when the used time exceeded 4000 minutes, and it can be said that the attenuation was stabilized, but the attenuation of the ROA continued until the used time reached 9000 minutes.

Experimental Examples 3, 4, and 5 provide results of ROAs when press pressures were 15000 g/cm$^2$, 19000 g/cm$^2$, and 23000 g/cm$^2$, respectively. In case of 15000 g/cm$^2$, the ROA of a wafer at the beginning of using the polishing pad was 0.23 μm, and it was sufficiently lower than that in Experimental Example 1. Moreover, a used time of 1000 minutes of the polishing pad can suffice to reduce the ROA to 0.20 μm or below, and sufficient wafer flatness was obtained after the ROA exceeded 1000 minutes. Additionally, an attenuation of the ROA was reduced when the used time reached approximately 1500 minutes, and the attenuation was rapidly stabilized as compared with Experimental Example 1.

It can be understood from each of Experimental Examples 4 and 5 that an ROA of a wafer at the beginning of using the polishing pad is low when a press pressure is high, and that an absolute value of the ROA is low after stabilization. That is, higher wafer flatness can be obtained.

Based on the above-explained experiment results, a press pressure in the high-pressure press processing at the step b is set to 15000 g/cm$^2$ or above.

Figure 6:
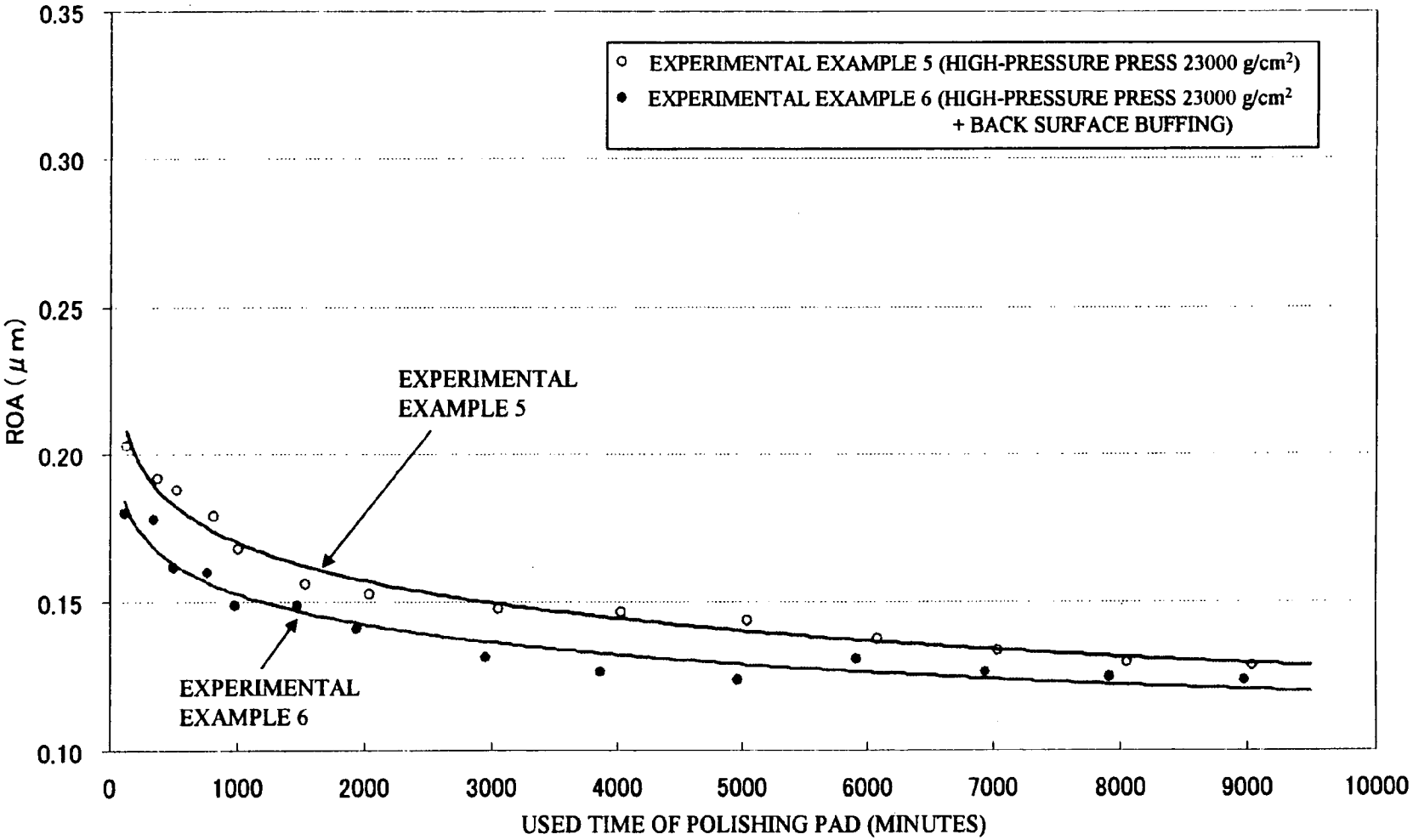
FIG. 6 is a graph showing a relationship between a used time and an ROA of the polishing pad.

FIG. 6 is a graph showing a relationship between a used time and an ROA of the polishing pad in each of Experimental Examples 5 and 6, i.e., examples with and without the back surface buffing processing when a press pressure is 23000 g/cm$^2$.

It can be understood from this graph that performing both the high-pressure press processing and the back surface buffing processing enables further effectively improving wafer flatness and its stability.

Figure 7:
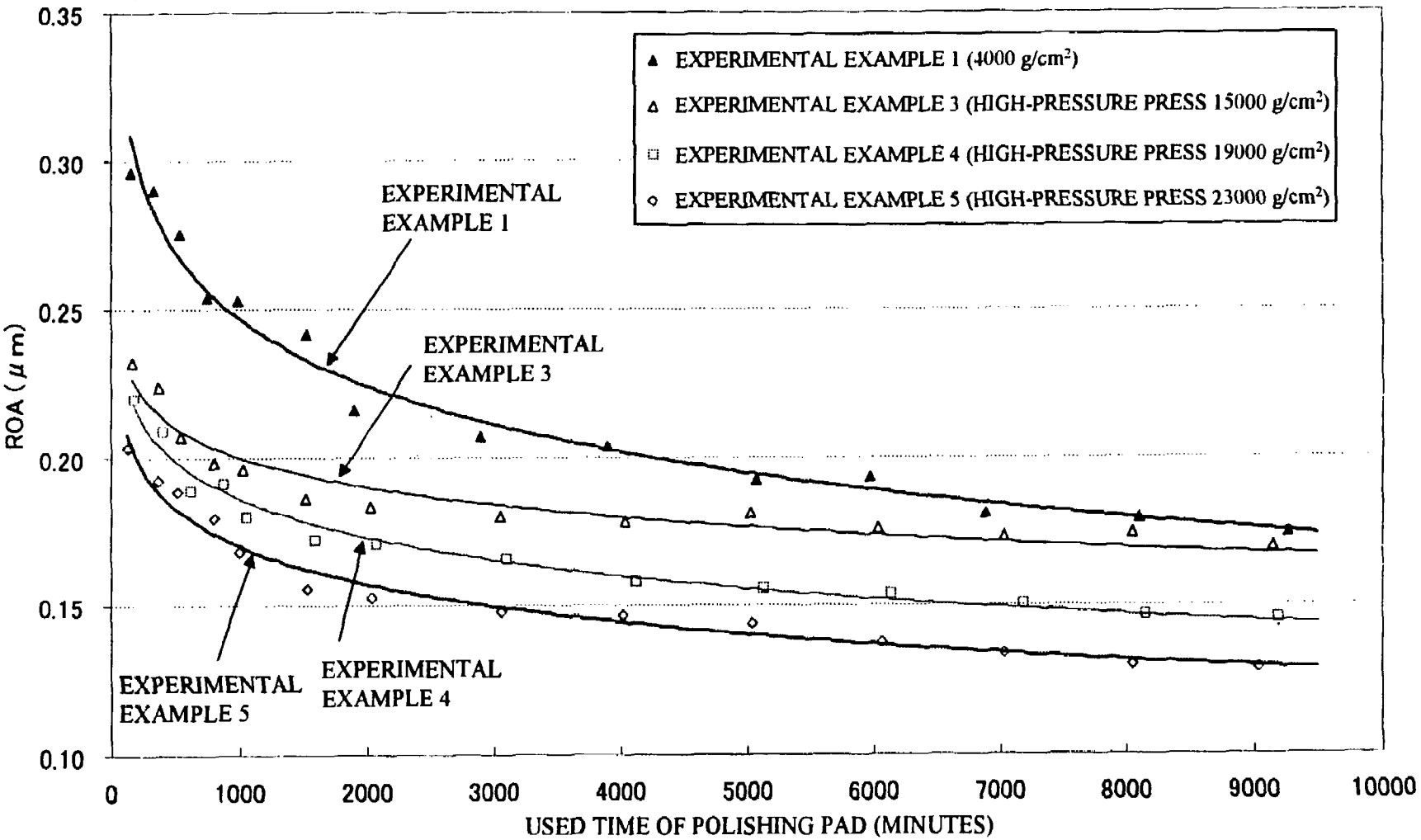
FIG. 7 is a graph showing a relationship between a used time and an ROA of the polishing pad.

FIG. 7 is a graph showing a relationship between a used time and an ROA of the polishing pad in Experimental Examples 1 and 2, i.e., examples with and without the back surface buffing processing when a press pressure is 4000 g/cm$^2$.

This graph shows that the back surface buffing processing enables improving wafer flatness even if the press pressure is as low as 4000 g/cm$^2$. However, an ROA of a wafer at the beginning of using the pad was still high, an attenuation of the ROA was reduced when the used time exceeded 3000 minutes, and an absolute value of the ROA after stabilization was equal to that in Experimental Example 1. It can be understood that the effect is insufficient when the back surface buffing processing alone is performed.

The following Table 1 shows a press pressure at the step b, with/without of the back surface buffing processing at the step c, a value of the ROA immediately after stating polishing (initial ROA), an approximate value of a used time of the polishing pad until a polishing quality is stabilized, and an appropriate level of the ROA after the polishing quality is stabilized in each of Experimental Examples 1 to 6.

TABLE 1

| | Experiment No. | | | | | |
|---|---|---|---|---|---|---|
| | 1 | 2 | 3 | 4 | 5 | 6 |
| Press Pressure ($g/cm^2$) | 4000 | 4000 | 15000 | 19000 | 23000 | 23000 |
| Back surface buffing processing | without | with | without | without | without | with |
| Initial ROA (μm) | 0.30 | 0.25 | 0.23 | 0.22 | 0.20 | 0.18 |
| Used time (minutes) of polishing pad until stabilization | 4000 | 2000 | 1500 | 1500 | 1500 | 1000 |
| ROA level (μm) after stabilization | 0.17 to 0.21 | 0.17 to 0.20 | 0.17 to 0.19 | 0.14 to 0.18 | 0.13 to 0.16 | 0.12 to 0.15 |

It can be understood from Table 1 that the initial ROA is low, the used time of the polishing pad until the polishing quality is stabilized is short, and the ROA level after the polishing quality is stabilized tends to be low when the press pressure at the step b is high. Further, it can be comprehended that combining the back surface buffing processing enables further increasing the effect.

As apparent from the experiments, when a wafer is polished by using the polishing pad manufactured by the polishing pad manufacturing method according to the present invention, the wafer can be polished with a very high polishing quality that the initial ROA is, e.g., 0.23 μm or below (0.19 μm or below in particular). Furthermore, it is particularly preferable to use the polishing pad according to the present invention that can obtain such an initial ROA for an operation after the ROA is stabilized.

It is to be noted that an upper limit of the pressure in the high-pressure press processing is not restricted in particular, but it is determined based on, e.g., a balance of a capability or a cost of the press apparatus, and it can be set to, e.g., 25000 $g/cm^2$ or below.

It is to be noted that the present invention is not restricted to the foregoing embodiments. The foregoing embodiments are just exemplifications, and any inventions, which have substantially the same structures as the technical concepts explained in claims of the present invention and demonstrate the same functions and effects are included in the technical scope of the present invention.

What is claimed is:

1. A method for manufacturing a polishing pad that is formed of a urethane foam pad and attached to a turn table to polish a wafer, the method comprising at least steps of:

slicing a urethane foam cake to provide the urethane foam pad; and performing press processing on the urethane foam pad with a pressure of 15000 $g/cm^2$ or more.

2. The method for manufacturing a polishing pad according to claim 1, having a step of buffing at least a surface of the urethane foam pad that is to be attached to the turn table after the step of performing the press processing.

3. The method for manufacturing a polishing pad according to claim 2, having a step of removing a peripheral portion of the urethane foam pad after the step of performing press processing.

4. The method for manufacturing a polishing pad according to claim 3, further comprising:

bonding a first surface of the urethane foam pad to a double-sided adhesive tape after performing the press processing, the first surface to be attached to the turn table; and buffing a second surface of the urethane foam pad, the second surface being opposite to the first surface.

5. A method for polishing a wafer, comprising at least steps of:

manufacturing the polishing pad using the method Of claim 4, attaching the polishing pad to the turn table, and using the turn table having the polishing pad attached thereto to polish the wafer with a polishing slurry interposed between a front surface of the polishing pad and the wafer.

6. A method for polishing a wafer, comprising at least steps of:

manufacturing the polishing pad using the method of claim 3, attaching the polishing pad to the turn table, and using the turn table having the polishing pad attached thereto to polish the wafer with a polishing slurry interposed between a front surface of the polishing pad and the wafer.

7. The method for manufacturing a polishing pad according to claim 2, further comprising:

bonding a first surface of the urethane foam pad to a double-sided adhesive tape after performing the press processing, the first surface to be attached to the turn table; and buffing a second surface of the urethane foam pad, the second surface being opposite to the first surface.

8. A method for polishing a wafer, comprising at least steps of:

manufacturing the polishing pad using the method of claim 7, attaching the polishing pad to the turn table, and using the turn table having the polishing pad attached thereto to polish the wafer with a polishing slurry interposed between a front surface of the polishing pad and the wafer.

9. A method for polishing a wafer, comprising at least steps of:

manufacturing the polishing pad using the method of claim 2, attaching the polishing pad to the turn table, and using the turn table having the polishing pad attached thereto to polish the wafer with a polishing slurry interposed between a front surface of the polishing pad and the wafer.

10. The method for manufacturing a polishing pad according to claim 1, having a step of removing a peripheral portion of the urethane foam pad after the step of performing press processing.

11. The method for manufacturing a polishing pad according to claim 10, further comprising:

bonding a first surface of the urethane foam pad to a double-sided adhesive tape after performing the press processing, the first surface to be attached to the turn table; and buffing a second surface of the urethane foam pad, the second surface being opposite to the first surface.

12. A method for polishing a wafer, comprising at least steps of:

manufacturing the polishing pad using the method of claim 11, attaching the polishing pad to the turn table, and using the turn table having the polishing pad attached thereto to polish the wafer with a polishing slurry interposed between a front surface of the polishing pad and the wafer.

13. A method for polishing a wafer, comprising at least steps of:

manufacturing the polishing pad using the method of claim 10, attaching the polishing pad to the turn table, and using the turn table having the polishing pad attached thereto to polish the wafer with a polishing slurry interposed between a front surface of the polishing pad and the wafer.

14. The method for manufacturing a polishing pad according to claim 1, further comprising:

bonding a first surface of the urethane foam pad to a double-sided adhesive tape after performing the press processing, the first surface to be attached to the turn table; and buffing a second surface of the urethane foam pad, the second surface being opposite to the first surface.

15. A method for polishing a wafer, comprising at least steps of:

manufacturing the polishing pad using the method of claim 14, attaching the polishing pad to the turn table, and using the turn table having the polishing pad attached thereto to polish the wafer with a polishing slurry interposed between a front surface of the polishing pad and the wafer.

16. A method for polishing a wafer, comprising at least steps of:

manufacturing the polishing pad using the method of claim 1, attaching the polishing pad to the turn table, and using the turn table having the polishing pad attached thereto to polish the wafer with a polishing slurry interposed between a front surface of the polishing pad and the wafer.

* * * * *